US007050018B2

(12) United States Patent
Weit

(10) Patent No.: US 7,050,018 B2
(45) Date of Patent: May 23, 2006

(54) MULTI-BAND ANTENNA SYSTEM

(75) Inventor: James Graham Weit, Sandusky, OH (US)

(73) Assignee: Machine Applications Corp., Sandusky, OH (US)

( * ) Notice: Subject to any disclaimer, the term of this patent is extended or adjusted under 35 U.S.C. 154(b) by 0 days.

(21) Appl. No.: 10/934,877

(22) Filed: Sep. 7, 2004

(65) Prior Publication Data

US 2006/0050006 A1 Mar. 9, 2006

(51) Int. Cl.
*H01Q 3/24* (2006.01)

(52) U.S. Cl. ..... 343/876; 343/745

(58) Field of Classification Search ..... 343/876, 343/745, 747, 750, 850
See application file for complete search history.

(56) References Cited

U.S. PATENT DOCUMENTS 4,201,990 A 5/1980 Altmayer ..... 343/747
4,564,843 A 1/1986 Cooper ..... 343/745
4,924,238 A 5/1990 Ploussios ..... 343/802
6,195,065 B1 * 2/2001 Hung et al. ..... 343/876
2004/0214605 A1 * 10/2004 Zhang et al. ..... 455/562.1

OTHER PUBLICATIONS

The Arrl Antenna Book Trap Antennas, pp. 7-8 to 7-11 Published by The American Radio Relay League Newington Ct.

The Arrl Antenna Book Coupling the Transmitter to the Line, pp. 25-1 to 25-14 Published by The American Radio Relay League Newington Ct.

* cited by examiner

*Primary Examiner*—Hoang V. Nguyen

(57) ABSTRACT

A radio antenna having radiating conductors (28,30,32) which can be connected together by the action of antenna switch modules (20,22,24), whereby the electrical length of said antenna can be changed. Power and control signals to said antenna switch modules, are conducted from the antenna controller (18) through the feed line (14), and said radiating conductors. The radiating direction of said antenna can be changed by a directional switch module (74), which receives power and control signals through said feed line from a directional control circuit (29). Thus said antenna can be tuned for a plurality of frequency bands, and the radiating direction can be changed, by remote control.

4 Claims, 4 Drawing Sheets

MULTI-BAND ANTENNA SYSTEM

CROSS-REFERENCE TO RELATED APPLICATIONS

Not applicable.

BACKGROUND

1. Field of Invention

This invention relates to radio frequency antennas, specifically to such antennas which are capable of operating over a wide frequency range.

2. Description of Prior Art

An antenna is usually positioned as high as practical and connected to a transmitter or receiver by way of a feed line. Antennas for use at radio frequencies are effective over a limited frequency range. The optimum operating frequency of an antenna is determined by its length. The lower the operating frequency, the longer the antenna must be.

When operation is required over a wide frequency range it is common to use multiple antennas with each antenna optimized for a specific narrow band of frequencies. The desired antenna is manually selected by a switch or other means that connects that antenna's feed line to the transmitter or receiver.

Since horizontal dipole antennas have a preferred direction of operation, more than one antenna of the same frequency band may be erected in order to achieve coverage in all directions. This creates the need for more feed lines, and more antenna selection switches.

A simple dipole antenna is often made of wire. The dipole may be connected to a transceiver by way of a coaxial cable feed line. The cost of the coaxial feed line is the most expensive part of such an antenna. When many separate antennas are needed in order to cover a broad range of frequencies or different directions, the cost of the feed lines can become significant.

When multiple antennas are used in close proximity, they can interfere with each other. The interference can be a disruption of the normal impedance of the antenna. The interference can also be a disruption of the normal radiation pattern of the antenna.

Another problem with multiple antennas is that a large physical space is required to accommodate them. Still another problem is the number of supports required to hold the multiple antennas as high as practical.

Because of the above mentioned problems, other methods have been devised to use a single antenna and feed line over a wide frequency range. One such method is to use an electrical network to match the impedance of an antenna of the incorrect length to the output impedance of the transceiver. This network is sometimes incorrectly called an antenna tuner. There are several problems with the antenna matching technique:

a) Some transmitter power is lost in the matching network and is not radiated by the antenna.
b) Considerable transmitter power can be lost in the feed line.
c) Undesirable radiation patterns with multiple lobes and deep nulls occur at frequencies above the resonant frequency of the antenna.
d) A slight change in operating frequency requires readjustment of the matching network.
e) Readjustment of the matching network takes time.
f) Antenna matching networks can be expensive, physically large, and cumbersome to operate.

A description of antenna matching techniques can be found in "The ARRL Antenna Book" 16$^{th}$ edition, pages 25-1 to 25-14.

Another method for using a single antenna and feed line over a wide frequency range is the trap antenna. This type of antenna employs networks of inductors and capacitors placed at key points along the length of the antenna. The networks are commonly called traps. One pair of traps is required for each band of frequencies on which the antenna is to operate. There are several problems with the trap antenna:

a) The large size and weight of the traps causes considerable wind load and support problems.
b) The traps have losses which prevents some of the transmitter power from being radiated by the antenna.
c) The traps are expensive to construct.
d) The bands of operation are narrow compared to a normal dipole.
e) The individual traps require tuning.
f) There is interaction between the traps which makes it difficult to get the antenna adjusted to all the desired operating points.

A description of trap antennas can be found in "The ARRL Antenna Book" 16$^{th}$ edition, pages 7-8 to 7-12.

Another method of making a single antenna and feed line operate over a wide frequency range is to place an antenna tuning network at the antenna end of the feed line as disclosed in U.S. Pat. Nos. 4,201,990 and 4,564,843. The purpose of this type of technique is to match the impedance of the non-resonant antenna to the impedance of the feed line. There are several problems with this technique:

a) The size and weight of the tuning network causes wind loading and support problems.
b) Other wires beside the feed line must run to the tuning network to power it and to control it.
c) Undesirable radiation patterns with multiple lobes and deep nulls occur at frequencies above the resonant frequency of the antenna.
d) The network must often be readjusted when even small changes in frequency are made.

A variation of the above method is disclosed in U.S. Pat. No. 4,924,238. In this method the elements of the tuning network are distributed along the length of a helically wound antenna structure. This method has all of the problems described above.

SUMMARY

In accordance with the present invention a multi-band antenna that is matched to the feed line by changing the physical length of the antenna by remote control. The direction of optimum operation of the antenna is also selected by remote control.

OBJECTS AND ADVANTAGES

Accordingly, several objects and advantages of my invention are:

a) The antenna is matched to the feed line impedance by changing the physical and thus the electrical length of the antenna. This provides a wider band width of operation over matching methods that use inductors and capacitors.

b) The antenna length is changed in incremental steps of any desired size, by the action of relays or switches. The length can be changed very rapidly compared to motor driven methods.

c) The individual switching modules can be made very small and light weight, in order to produce minimal support and wind load problems.

d) Control signals and power to the individual switching modules are conducted through the antenna feed line. This eliminates the need for additional control wires between the control point and the antenna, thus reducing support and wind load problems as well as cost.

e) The normal radiation pattern of a dipole antenna is preserved, thus eliminating the multiple deep nulls that occur with other multi-band antennas when the electrical length of the antenna greatly exceeds a wave length.

f) The invention is also applicable to antennas other than simple dipoles. It can also be used with monopole and yagi antennas, or, any antenna where matching to a feed line can be accomplished by changing the length of a conducting element of the antenna.

g) The invention can also be used to change the directional quality of an antenna by changing the length of elements of the antenna such as directors or reflectors, or by connecting the feed line to different elements of the antenna with different spatial orientations.

Further objects and advantages of the invention will become apparent from a consideration of the drawings and ensuing description.

DRAWING FIGURES

DESCRIPTION OF THE PREFERRED EMBODIMENT OF THE INVENTION

Figure 1:
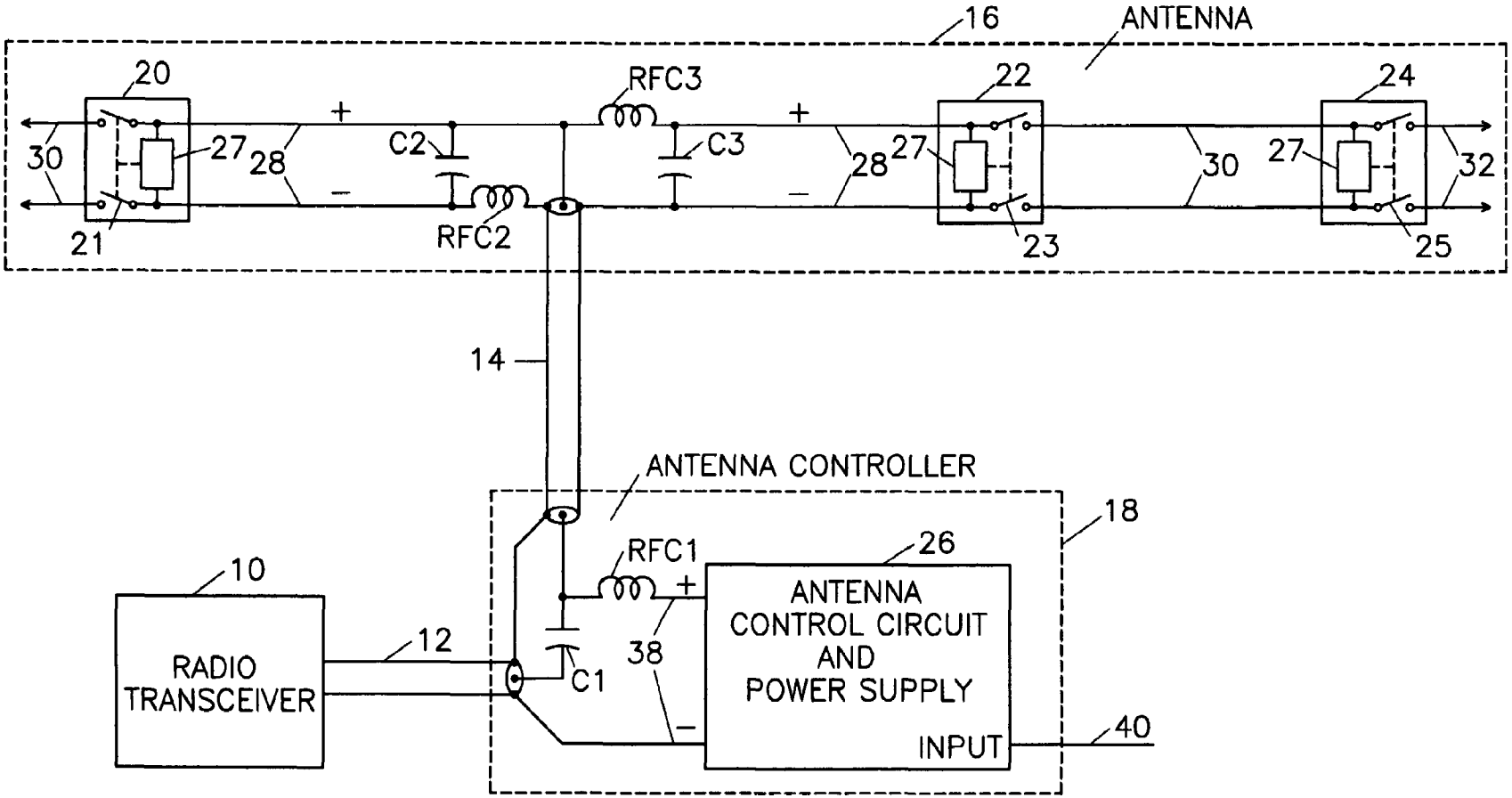
FIG. 1 shows an over all view of the antenna and controller.

FIG. 1 shows an over all view of the multi-band antenna, the antenna controller, and the transceiver that is connected to the antenna. The radiating components of the antenna are shown at 16. The antenna feed line 14 connects the antenna to the antenna controller 18. A coaxial cable 12 connects the antenna controller to a radio transceiver 10.

The antenna controller 18 is comprised of an antenna control circuit and power supply 26, with an output 38, a radio frequency choke RFC1, a capacitor C1 and an input 40.

The radiating part of the antenna 16 is comprised of two radio frequency chokes RFC2 and RFC3, two capacitors C2, and C3, radiating conductors or antenna wires 28, 30, and 32, and antenna switch modules 20, 22, and 24. The antenna switch modules include switching elements or relay contacts 21, 23, 25 and electronic circuits 27.

Figure 2:
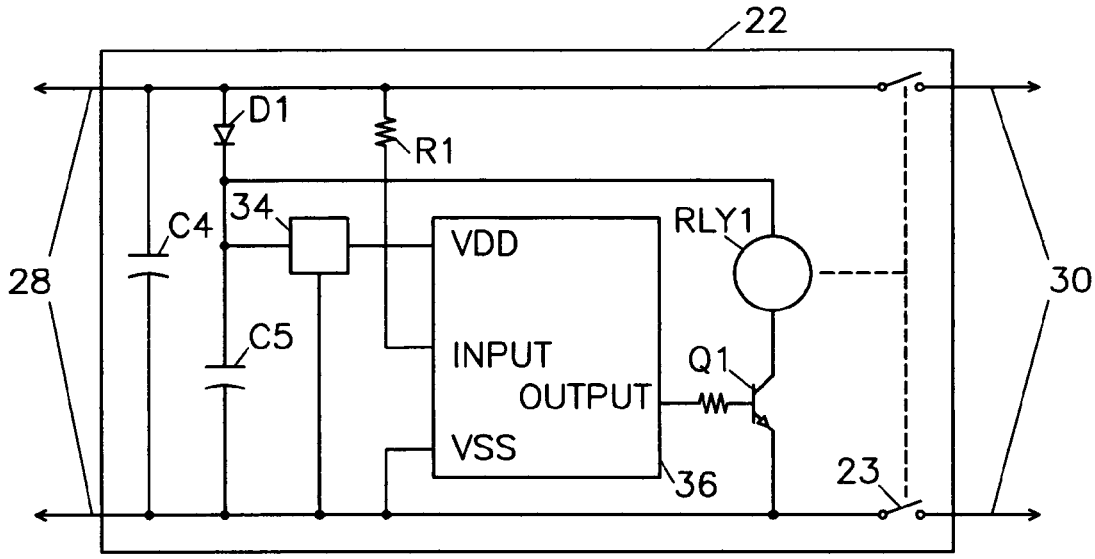
FIG. 2 is a representative schematic diagram of the antenna switch module.

FIG. 2 is a more detailed diagram of the antenna switch module 22. The antenna switch module 22 is comprised of capacitors C4 and C5, a diode D1, a voltage regulator 34, a micro controller 36, an input resistor R1, a transistor Q1, and a relay RLY1 with contacts 23. The components of the antenna switch module 22 are connected to antenna wires 28 and 30.

Figure 3:
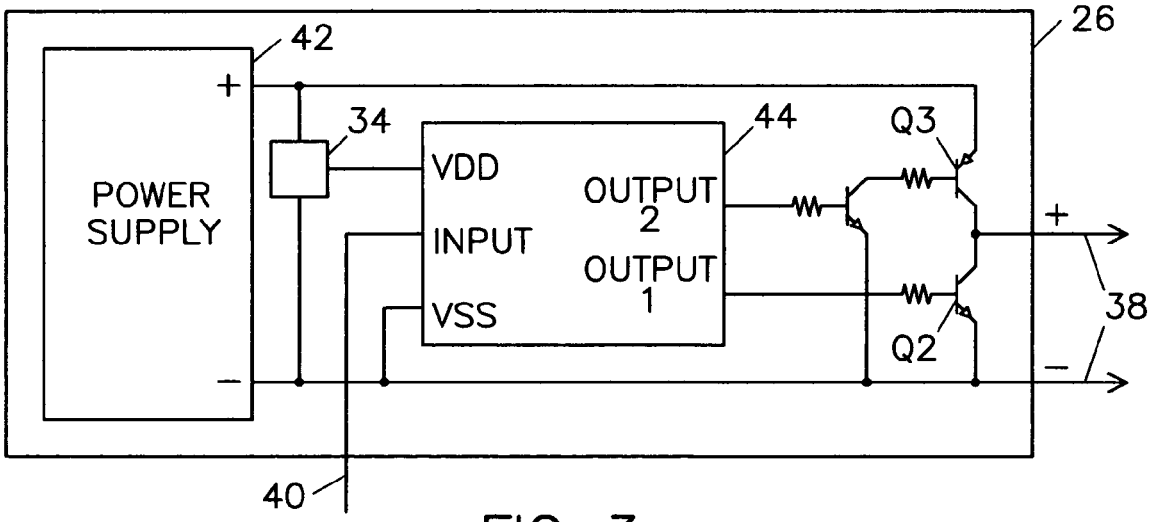
FIG. 3 is a representative schematic diagram of the antenna switch controller.

FIG. 3 is a more detailed diagram of the antenna control circuit 26 shown in FIG. 1. It is comprised of a power supply 42, a voltage regulator 34, a micro controller 44, an input 40, output transistors Q2 and Q3 and an output 38.

Figure 4:
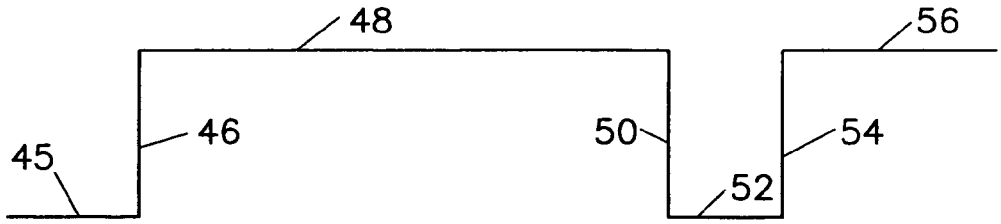
FIG. 4 shows the key features of the electrical output waveform of the antenna controller.

FIG. 4 shows the output voltage waveform of the antenna controller shown in FIG. 3 Voltage is indicated vertically, and time is shown horizontally. The waveform starts at zero volts 45. The voltage increases to maximum 46. The voltage stays at the maximum value 48, and then decreases to zero 50. The voltage stays at zero for a short time 52, then increases again to the maximum 54. The voltage stays at the maximum value 56.

Figure 5:
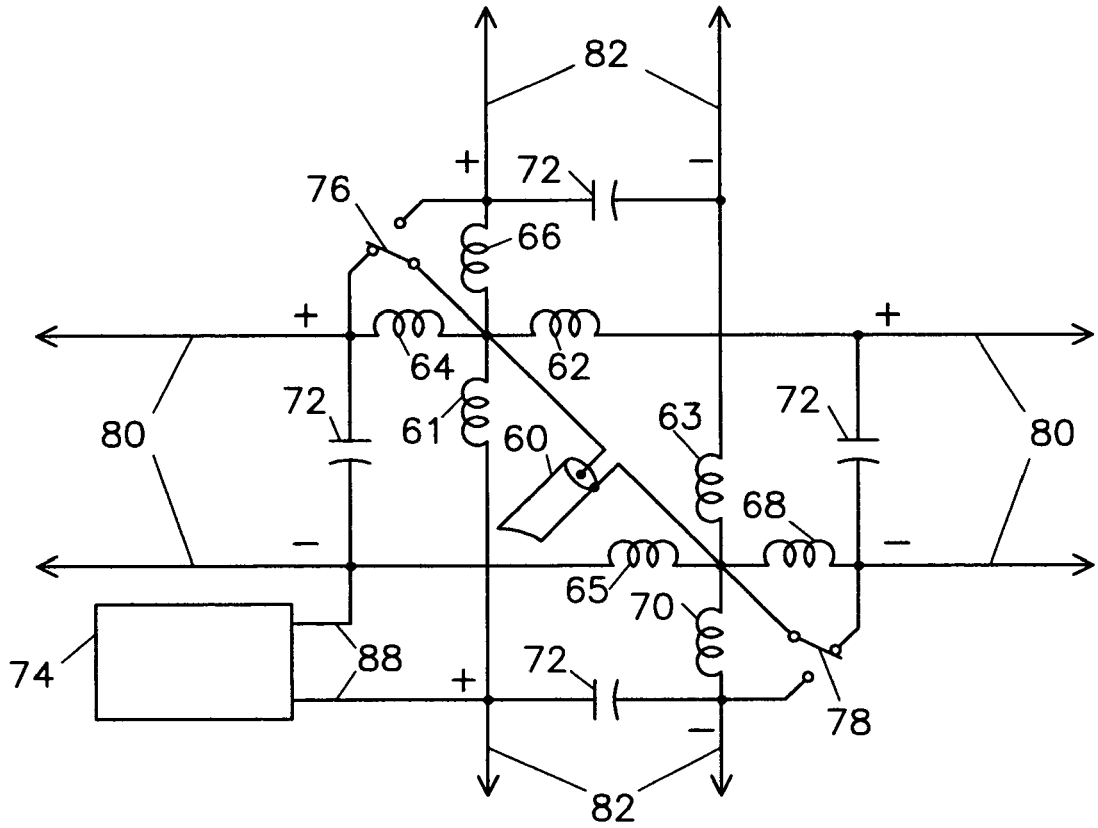
FIG. 5 shows the arrangement of a directional antenna switch for switching between two antennas.

FIG. 5 is a diagram showing the intersection of two antennas which are spatially oriented to radiate in different directions. One antenna is comprised of conductors 80, and the other is comprised of conductors 82. Both of these antennas 80 and 82 are fed by feed line 60. Four radio frequency chokes 61, 62, 64, and 66 are connected to the center conductor of the feed line 60. Four radio frequency chokes 63, 65, 68, and 70 are connected to the outer conductor of the feed line 60. A relay contact 76 is arranged so that it can short out either choke 64 or choke 66. Another relay contact 78 is arranged so that it can short out either choke 68 or 70. Relay contacts 76 and 78 are part of a relay within the directional antenna switch module 74. The relay contacts 76 and 78 are shown displaced from the directional antenna switch module 74 for clarity. Power to the directional antenna switch module 74 is supplied by conductors 88, one of which is connected to the negative wire of antenna 80, and the other to the positive wire of antenna 82. Four capacitors 72 are connected across the conductors of each of the two antennas 80 and 82.

Figure 6:
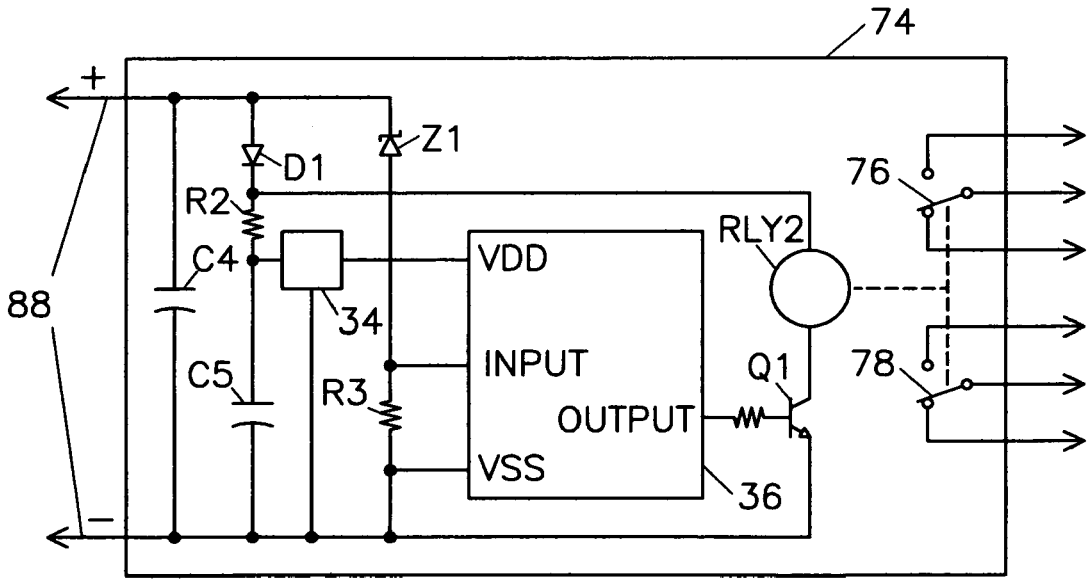
FIG. 6 shows a representative schematic diagram of the directional antenna switch for switching between two antennas.

FIG. 6 is a schematic diagram of the internal circuitry of the directional antenna switch module 74 shown in FIG. 5. The directional antenna switch module 74 is similar to the antenna switch module 22 of FIG. 2. The directional antenna switch module 74 is comprised of capacitors C4 and C5, resistors R2 and R3, a diode D1, a voltage regulator 34, a zener diode Z1, a micro controller 36, a transistor Q1, a relay RLY2, and relay contacts 76,and 78. Power is connected to the directional antenna switch 74 through wires 88.

Figure 7:
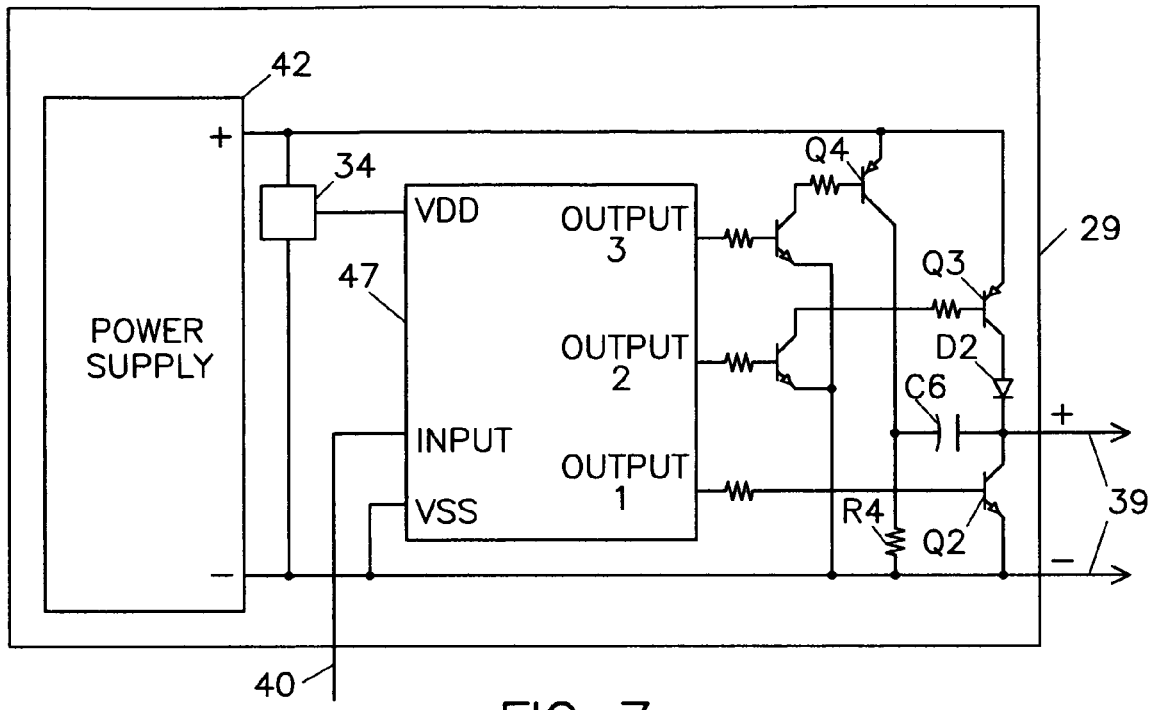
FIG. 7 shows a representative schematic diagram of the antenna controller for use with the directional antenna switch for switching between two antennas.

FIG. 7 is a schematic diagram of a directional antenna control circuit and power supply 29. The control circuit is comprised of a power supply 42, a voltage regulator 34, a micro controller 47, three output transistors Q2, Q3, Q4, a diode D2, an input 40, and an output 39.

Figure 8:
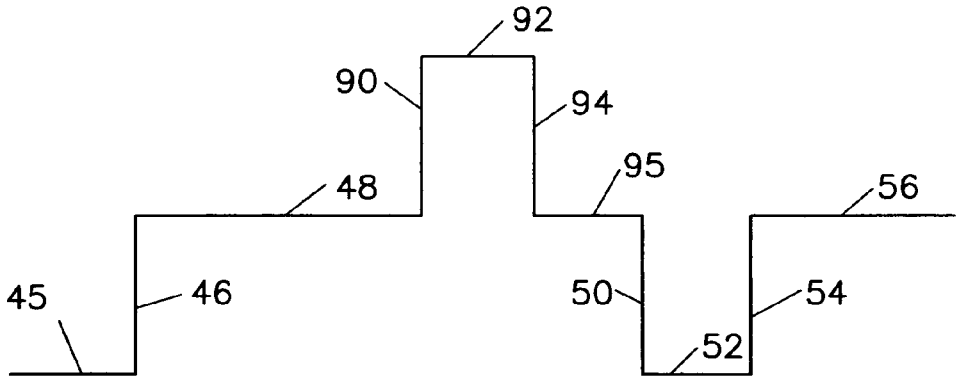
FIG. 8 shows the key features of the output waveform of the antenna controller of FIG. 7.

FIG. 8 shows the output voltage wave form of the directional antenna control circuit 29, shown in FIG. 7. Voltage is indicated vertically and time is shown horizontally. The wave form starts at zero volts 45. The voltage then increases 46 to level 48 which is equal to the output voltage of the power supply 42. After a time the voltage increases 90 and stays for a time 92 at a level of twice the voltage of the power supply 42. The voltage then goes down 94 and stays at the level of the power supply voltage 95. After a time 95 the voltage falls back to zero 50 and stays at zero for a time 52. The voltage then increases 54 and stays at the power supply voltage 56.

OPERATION OF THE PREFERRED EMBODIMENT OF THE INVENTION

As illustrated in FIG. 1, with relay contacts 21 and 23 open as shown, a dipole antenna is formed by antenna wires 28 and antenna switch modules 20 and 22.The purpose of capacitor C2 is to assure that the positive and negative antenna wires 28 that connect to antenna switch module 20 are at the same radio frequency potential. The purpose of radio frequency choke RFC2 is to prevent capacitor C2 and the input impedance of antenna switch 20 from loading the radio frequency output of the feed line 14. Capacitor C3 and radio frequency choke RFC3 are for the same purpose on the antenna wires 28 that are connected to antenna switch module 22.

The resonant frequency of the antenna 16 is determined by the length of antenna wires 28, and the physical size of the antenna switch modules 20 and 22. When relay contacts 21 and 23 are closed, a dipole antenna of a longer length is formed. The resonant frequency of this antenna is determined by the total length of antenna wires 28 and 30, and the physical size of antenna switch modules 20 and 22 and 24 plus an antenna switch module that is not shown to the left. Any number of pairs of antenna switch modules can be used along with lengths of antenna wires to provide a dipole antenna the length of which can be selected by closing relay contacts in successive pairs of antenna switch modules.

The direct current power source for the electronic circuits 27 in the antenna switch modules comes from the antenna control circuit and power supply 26, located in the antenna controller 18. The direct current power at wires 38 is conducted to antenna switch modules 20 and 22 through radio frequency choke RFC1, through the feed line 14, through radio frequency chokes RFC2 and RFC3, and through antenna wires 28. Capacitor C1 prevents the direct current power on wires 38 from entering the radio transceiver 10 through the coaxial cable 12. When relay contacts 21 and 23 are closed, direct current power can then flow to the next pair of antenna switch modules through antenna wires 30. As relay contacts are closed in successive pairs of antenna switch modules, direct current power is fed through the relay contacts to the next pair of antenna switch modules which are located farther from the antenna feed line.

The antenna control circuit and power supply 26 also produces a signal which is conducted to the antenna switch modules through the same path as is the direct current power. The exact nature of this signal is explained later; however, this signal can cause any number of pairs of antenna switch modules to energize their respective relays thus closing their associated relay contacts. The antenna control circuit and power supply 26 generates the appropriate signal in response to an input signal 40. This input signal can come from a manually operated switch or it can be a serial or parallel input signal from a computer or micro controller. Many radio transceivers include a serial port which can be used to control external devices. This serial port can generate a serial signal which indicates the frequency to which the transceiver is set. This serial signal can be connected to the input 40. The antenna controller 18 can then be controlled through input 40 and made to produce the appropriate signal to cause the required number of pairs of antenna switch modules to close their respective relay contacts and thus set the length of the antenna to match the operating frequency of the transceiver.

FIG. 2 shows the circuitry within antenna switch module 22. The circuitry of all the antenna switch modules is identical. Capacitor C4 assures that antenna wires 28 are at the same radio frequency potential. When direct current power is applied to antenna wires 28, capacitor C5 is charged through diode D1. Capacitor C5 is large enough in capacitance to supply power to voltage regulator 34 and relay RLY1 even when direct current power is removed from antenna wires 28 for short periods of time on the order of hundreds of microseconds. Diode D1 prevents the fast discharge of capacitor C5 when the direct current voltage across antenna wires 28 goes to zero. Voltage regulator 34 supplies the appropriate voltage to the micro controller 36. Since the direct current voltage across antenna wires 28 may be greater than the allowed input voltage to the micro controller, resistor R1 limits the current that flows through the input protection diodes of the micro controller. The input to the processor is high whenever direct current power is present across antenna wires 28. When the direct current voltage across antenna wires 28 goes to zero for a short time such as 100 microseconds, the input to the micro controller 36 goes to a low logic level. Power to the micro controller is maintained by the charge on capacitor C5 during the short time that the input to the micro controller is low. The program of the micro controller 36 interprets the momentary low input as a command to turn on relay RLY1. The output of the micro controller then goes high which turns on transistor Q1 which energizes relay RLY1. Relay contacts 23 then close, sending direct current power to the next successive antenna switch module through antenna wires 30. With successive short pulses of zero direct current voltage, relay contacts of successive antenna switch modules are made to close, thus lengthening the antenna and making it resonant at a lower frequency.

FIG. 3 shows the circuitry of the antenna control circuit and power supply. The power supply 42 puts out at direct current voltage which is higher than the required operating voltage of micro controller 44 and is of the appropriate voltage to operate the relays in the antenna switch modules. Voltage regulator 34 provides the correct voltage to the micro controller 44.

When output 2 of the micro controller is high, transistor Q3 is turned on which applies the power supply voltage to wires 38. The direct current voltage on wires 38 is conducted to wires 28 in FIG. 2. When output 2 of micro controller 44 is low, transistor Q3 is off. If output 1 of micro controller 44 then goes high, transistor Q2 will be turned on which will make the direct current voltage on wires 38 go to near zero. The sequence of the direct current voltages on wires 38 is determined by the program of micro controller 44. The input signal 40 to micro controller 44 causes the micro controller program to generate the appropriate direct current voltage wave form to turn on the desired number of pairs of antenna switch module relays.

FIG. 4 shows a typical sequence of voltages on wires 38 which is the same as the voltage on wires 28 of FIG. 2. Initially the voltage is zero as shown by 45. When the power supply 42 is turned on 46, the voltage goes to maximum. This voltage is conducted to the first pair of antenna switch modules and provides power to the micro controllers within the antenna switch modules. At this point the antenna is at its shortest possible length and can be operated on its highest possible frequency band. The voltage stays at the maximum level for as long as operation on the highest frequency band is desired 48. When an appropriate input signal 40 of FIG. 3 signals the micro controller to turn on the relays in the first pair of antenna switch modules, the voltage in FIG. 4 goes to zero 50, stays at zero for a short time 52 and then goes back to maximum 54. This part of the wave form is the control signal. Capacitor C5 provides power during the period of the zero voltage pulse. When the zero voltage pulse 50, 52, and 54 is applied to the first pair of antenna switch modules, their micro controllers are fed a momentary low input pulse which signals the micro controllers in the antenna switch modules to energize their respective relays. This action then applies direct current power to the next pair of antenna switch modules, and lengthens the antenna to the next lower frequency band. The antenna stays at this newly selected length for as long as direct current power remains applied 56. In this same way, successive zero going pulses will cause successive pairs of antenna switch modules to energize their relays thus causing the antenna to be lengthened. When it is desirable to shorten the length of the antenna, direct current power is removed for a time long enough for the capacitors in all antenna switch modules to discharge, thus allowing all relays to drop out. Direct current power is then applied again, and a series of zero going pulses causes the desired number of pairs of relays to be energized.

The form of operation described above allows all antenna switch modules to be identical in terms of hardware and software. If different software is allowed for each pair of antenna switch modules, then it is possible to cause any particular pair of antenna switch modules to drop out their relays based on data conveyed in the form of multiple zero going pulses or by the width of an individual pulse. A serial data stream can be used to communicate with a particular pair of antenna switch modules as long as the charge on capacitor C5 in the antenna switch modules remains high enough to power the micro controllers and relays.

FIG. 5 shows a directional antenna switch module 74 which can connect the RF output of the feed line 60 to the antenna composed of wires 80, or to the antenna composed of wires 82. The radio frequency chokes 61, 62, 63, 64, 65, 66, 68, and 70 act as high impedance to RF but allow the conduction of direct current power to the antenna wires 80 and 82 and to the directional antenna switch module 74 through wires 88. The capacitors 72 keep the positive and negative antenna wires at the same RF potential. The relay contacts 76 and 78 are part of the antenna switch module 74, but are shown separated for clarity. With the relay contacts 76 and 78 in the state shown, radio frequency chokes 64 and 68 are shorted, and the feed line 60 is connected to antenna wires 80. When the relay contacts change state, they short radio frequency chokes 66 and 70, thus connecting the feed line 60 to antenna wires 82. Direct current power to operate the directional antenna switch module 74, and the signal which causes it to energize or drop out the relays is passed through the feed line 60, through radio frequency chokes 61 and 65, and then through wires 88.

FIG. 6 shows the internal circuitry of the directional antenna switch module 74. Capacitor C4 acts to keep the RF potential across wires 88 very low. The direct current voltage across wires 88 charges capacitor C5 through diode D1 and resistor R2. Capacitor C5 supplies power to the relay and voltage regulator during the zero voltage control pulse periods to the antenna switch modules. Voltage regulator 34 supplies the appropriate voltage to the micro controller 36. Resistor R3 keeps the input to the micro controller 36 low until the direct current voltage across wires 88 is high enough to cause zener diode Z1 to conduct. The zener voltage is higher than the direct current power voltage across wires 88. This arrangement requires that the direct current voltage across wires 88 must go higher than the zener voltage to produce a positive going input to the micro controller 36. The program of the micro controller causes the output to go high and turn on transistor Q1 when the input first goes high. When transistor Q1 turns on, relay RLY2 is energized and relay contacts 76 and 78 switch from one antenna to the other. The program causes the output of the micro controller 36 to go low the next time that the input goes high. The relay is thus energized and de-energized on alternate positive input pulses to the micro controller. In this way a selection is made as to which antenna is active.

FIG. 7 shows the circuitry of an antenna control circuit and power supply 29. This circuit can generate the zero voltage pulses that are needed to control the antenna switch modules 22 of FIG. 1 and FIG. 2. This circuit can also generate pulses that go higher than the output voltage of the power supply 42. The program of the micro controller 47 can generate the waveform of FIG.4 through the action of output 1 and output 2. These outputs turn transistors Q2 and Q3 on and off as required. When transistor Q3 is on, capacitor C6 is charged through diode D2 and resistor R4 to a voltage slightly less than the output voltage of the power supply 42. When output 3 of the micro controller 45 goes high, transistor Q4 turns on and connects the negative side of capacitor C6 to the positive output of the power supply 42. The voltage across the capacitor is now added to the supply voltage and appears at the output wires 39. At this time diode D2 blocks this voltage from being applied to transistor Q3.

FIG. 8 shows the output waveform of the circuit of FIG. 7 that appears across wires 39. Lines 90, 92, and 94 show the output pulse that goes higher than the power supply voltage as represented by line 48. This pulse is the direction control signal. It is this pulse that causes zener diode Z1 in FIG. 6 to conduct and provide an input signal to micro controller 36. The micro controller 36 then turns relay RLY2 on or off on successive pulses, and thus selects either of two antennas.

CONCLUSION, RAMIFICATIONS, AND SCOPE

Thus is described one possible embodiment of the invention which makes possible a multi-band antenna system which can be made to cover many bands of operation in discrete steps, by changing the length of the antenna conductors by the action of switching elements which can be remotely controlled. Such an antenna system can be used for receiving or transmitting on the selected frequency band.

Also described was a method of changing the direction of operation of the antenna by connecting between different antenna conductors by the action of switching elements which can be remotely controlled.

The system described can be controlled manually through the actuation of switches, or automatically by serially transmitted frequency information from the transceiver to which the antenna is connected. Also the antenna control circuit could easily be made part of a transceiver and operated directly by the internal control circuitry of the transceiver.

A method was shown for transmitting both direct current power and control signals to the antenna switching circuits through the antenna feed line that conducts RF energy between the transceiver and the antenna, thus eliminating additional control wires between the transceiver and the antenna.

The system described by this invention can be used to make multi-band monopole antennas and multi-band antennas comprised of multiple elements such as Yagis.

Although the description above contains many specifications, these should not be construed as limiting the scope of the invention but as merely providing illustrations of the presently preferred embodiment of this invention.

Thus the scope of the invention should be determined by the appended claims and their legal equivalents, rather than by the examples given.

I claim:

1. A multi-band antenna system comprising:

a) At least a pair of spatially somewhat parallel radiating conductors fitted with a plurality of relays arranged along the length of said radiating conductors in a way that allows the effective length of said parallel radiating conductors to be changed by the action of the contacts of said relays, b) a first means of electrically isolating said pair of parallel radiating conductors in order that direct current and low frequency control signal voltages may exist between them, c) a second means of extracting power and control signals from said parallel radiating conductors in order to activate said relays in accordance with electrical signals from a remotely located controller, d) a third means of electrically connecting said pair of parallel radiating conductors together at high frequencies allowing said parallel radiating conductors to act as a single radiating conductor, e) a fourth means of conducting direct current power and control signals to said relays from said controller through the antenna feed line conductors and the said parallel radiating conductors without interference to or from the radio frequency signals utilizing the same conductors.

2. An antenna system as claimed in claim 1 wherein the remote control is initiated either manually, or automatically by frequency of operation information derived from the serial control port of a transceiver which is utilizing said antenna.

3. An antenna system as claimed in claim 1 wherein the remote control action is automatically initiated by the internal control circuits of a transceiver which is utilizing said antenna.

4. An antenna system as claimed in claim 1 wherein a means is provided to switch between different radiating conductors spatially oriented to provide a different directionality of the antenna, and a means of conducting power and control signals to the switching circuit through the feed line without interference to or from the control signals to the said switching elements which select the frequency band of operation of said antenna.

* * * * *